US011578466B2

(12) United States Patent
Alberson et al.

(10) Patent No.: US 11,578,466 B2
(45) Date of Patent: Feb. 14, 2023

(54) TRAFFIC BARRIER AND SOUNDWALL SYSTEM

(71) Applicant: Vandorf SW1 Inc., Stouffville (CA)

(72) Inventors: Dean Clinton Alberson, Kerrville, TX (US); Mark Christopher Ayton, Welland (CA); Mohammed Talha Ghuman, Newmarket (CA); Benjamin Fraser Powell, King City (CA)

(73) Assignee: Vandorf SW1 Inc., Stouffville (CA)

( * ) Notice: Subject to any disclaimer, the term of this patent is extended or adjusted under 35 U.S.C. 154(b) by 136 days.

(21) Appl. No.: 17/204,586

(22) Filed: Mar. 17, 2021

(65) Prior Publication Data

US 2021/0292981 A1 Sep. 23, 2021

Related U.S. Application Data

(60) Provisional application No. 62/991,267, filed on Mar. 18, 2020.

(51) Int. Cl.
*E01F 15/00* (2006.01)
*E01F 8/00* (2006.01)
(Continued)

(52) U.S. Cl.
CPC ..... *E01F 8/0017* (2013.01); *E01F 8/0023* (2013.01); *E01F 15/083* (2013.01);
(Continued)

(58) Field of Classification Search
CPC ..... E01F 15/088; E01F 15/083; E01F 15/085; E01F 8/0017; E01F 8/0023
See application file for complete search history.

(56) References Cited

U.S. PATENT DOCUMENTS 4,214,411 A * 7/1980 Pickett ..... E01F 8/0017 52/144
5,619,829 A * 4/1997 Tan ..... E01F 8/0023 404/9

(Continued)

FOREIGN PATENT DOCUMENTS

DE 29608228 U1 * 8/1996 ..... E01F 8/0017
DE 202012008071 U1 1/2013

(Continued)

*Primary Examiner* — Thomas B Will
*Assistant Examiner* — Katherine J Chu
(74) *Attorney, Agent, or Firm* — John G. Fischer, Esq.; Scheef & Stone, L.L.P.

(57) ABSTRACT

A traffic barrier and soundwall system is disclosed having wide-flanged [or H-posts] vertical posts oriented with a flange facing a roadway. Traffic barriers are located between them. The barriers have recesses at the intersection of their backs and ends. An angle bracket is positioned in the recess to separate the post from the barrier. A U-shaped strap has a base and a pair of arms extending from the base. Traffic barriers are positioned against the posts so that the angle brackets in the recesses are adjacent to the road-facing flange of the post. A strap fastener connects an arm of the strap to the recess of each of the adjacent traffic barriers. In this way, the base of the strap surrounds the rearward-facing flange of the post to secure the traffic barriers to the post. Sound barrier panels are located on the top of the traffic barriers, secured between the webs of the neighboring posts.

15 Claims, 11 Drawing Sheets

(51) Int. Cl.
*E01F 15/08* (2006.01)
*E02D 27/42* (2006.01)

(52) U.S. Cl.
CPC ..... *E01F 15/085* (2013.01); *E01F 15/088* (2013.01); *E02D 27/42* (2013.01)

(56) References Cited

U.S. PATENT DOCUMENTS

| | | | | |
|---|---|---|---|---|
| 7,220,077 | B2 | 5/2007 | Humphries et al. | |
| 3,061,926 | A1 | 11/2011 | Riddell et al. | |
| 9,670,631 | B2 * | 6/2017 | Ditta | E01F 15/083 |
| 10,221,529 | B1 | 3/2019 | Sanders et al. | |
| 2019/0211518 | A1 | 7/2019 | Humphries et al. | |

FOREIGN PATENT DOCUMENTS

| | | | | | |
|---|---|---|---|---|---|
| EP | 1148175 | A1 | * | 10/2001 | E01F 8/0023 |
| FR | 1329222 | A | * | 6/1963 | |
| FR | 3022566 | B1 | * | 7/2020 | E01F 15/083 |
| JP | 5701435 | B1 | | 4/2015 | |
| KR | 20040081683 | A | * | 9/2004 | |
| KR | 200405959 | Y1 | * | 1/2006 | |
| KR | 20110128620 | A | * | 11/2011 | |

* cited by examiner

TRAFFIC BARRIER AND SOUNDWALL SYSTEM

RELATED APPLICATION

This application claims priority to Provisional Application 62/991,267, filed Mar. 18, 2020.

FIELD OF THE DISCLOSURE

This disclosure relates to a system that combines an impact absorbing traffic barrier system with a noise dampening soundwall. The connectivity of these elements is unique to the present invention.

BACKGROUND

Current traffic barrier and soundwall systems are difficult to install, difficult and expensive to repair, and upon impact by a vehicle, they provide inadequate resistance to movement, resulting in underride, override, uncontrolled deflection and unacceptable damage to the impacting vehicles.

There is a need for a traffic barrier and soundwall system that is easier to install and less expensive to repair. There is also a need for a traffic barrier and soundwall system that, upon impact by a vehicle, provides improved resistance to movement and thus to underride, override, uncontrolled deflection and unacceptable damage to the impacting vehicles.

There is a need for a traffic barrier and soundwall system that is easy to transport and efficiently installed. There is a need that it be aesthetically pleasing on the front side and rear side.

An advantage of the several embodiments of the disclosed invention is that they provide a means for effectively connecting precast concrete barriers together in a series connection around vertical posts to achieve maximum stability of the barrier system. Another advantage of the embodiments of the disclosed invention is that the vertical posts serve a second purpose of a mounting system for sound dampening or reflecting panels.

Another advantage of the embodiments of the disclosed invention is that it provides a simple and light-weight barrier to barrier connection method that is easy to transport and install and provides the backside of the system with a uniform and uninterrupted appearance.

In summary, the disclosed invention provides a unique solution to the engineering constraints and challenges of providing a traffic barrier and soundwall system that provides increased safety and cost-efficient installation and repair. Further, the embodiments of the disclosed invention satisfy the crash test requirements of AASHTO MASH TL-3.

The advantages and features of the embodiments presently disclosed will become more readily understood from the following detailed description and appended claims when read in conjunction with the accompanying drawings in which like numerals represent like elements.

SUMMARY

A traffic barrier and soundwall system is disclosed. In one embodiment, a plurality of wide-flanged vertical posts is provided. The posts have a central web with a first flange centered on one end of the web and a second flange centered on the opposite end of the web. The posts are oriented with the first flange facing a roadway along which traffic sound is to be limited.

A first traffic barrier is located between a first and second post. A second traffic barrier is located between the second and a third post. Each traffic barrier comprises a front and an opposite back, a first end and an opposite second end, and a top and a bottom. A first recess is located at the intersection of the back and the first end. A second recess is located at the intersection of the back and the second end. The first recess and second recess each have a recess front and a recess end.

In one embodiment, one or more threaded inserts are precast into the traffic barrier, facing the recess end of each of the first and second recess. The inserts may be connected to a reinforcing rebar structure that is also precast internal to the traffic barrier. The inserts may include a bracket insert and a strap insert.

An angle bracket is provided. The angle bracket has a bracket front and a bracket end. An orifice may be located on the angle bracket end for receiving a bracket fastener. The angle bracket is located at the intersection of the recess front and recess end of each of the first and second recesses of the first and second traffic barriers.

A bracket fastener located in the orifice of each angle bracket connects to a bracket insert at each recess end of each traffic barrier to secure the angle bracket to the traffic barrier. The bracket inserts may be connected to the reinforcing rebar structure that is also precast internal to the traffic barrier.

The first and second traffic barriers are positioned in relation to the posts so that the bracket fronts in the recesses of the traffic barriers are adjacent to the first flange of a post to prevent engagement of the concrete bodies of the traffic barriers with the first flange of the post.

To minimize damage resulting from engagement of the concrete traffic barrier with the steel post, the angle bracket may be made of metal, such as steel. In another embodiment, the angle bracket is made of a compressible material such as a thermoplastic polymer. In another embodiment, the angle bracket is made of a high-density polyethylene (HDPE).

A plurality of U-shaped strap connectors is provided, each having a base and a pair of arms extending perpendicularly from the base, and an orifice is located on each arm for receiving a strap fastener.

A strap fastener connects one arm of the strap connector to a strap insert in the first recess of the first traffic barrier. Another strap fastener connects the other arm of the strap connector to a strap insert in the second recess of the second traffic barrier. The strap inserts may be connected to the reinforcing rebar structure that is also precast internal to the traffic barrier.

In another embodiment, the strap fastener is located proximate to the top of the first traffic barrier to permit tool entry access for rotating the strap fastener to make its connection to the first traffic barrier.

Connected in the manner described, and as unique to the present invention, the base of the strap connector surrounds the second flange of the second post to interconnect longitudinal steel reinforcement within the first and second traffic barriers around the vertical post to provide a continuous tensile member along the back side of the system.

A sound barrier panel is located on the top of the traffic barriers and extends between the web of the first post and the web of the second post. In one embodiment, the sound panels have a longitudinal slot along the length of their bottom edge. The sound panels also have a longitudinal ridge along the length of their top edge. In this manner, sound barrier panels may be stacked between the web of the first post and the web of the second post to the desired height. The slots and ridges of vertically adjacent sound panels nest to enhance alignment and sound absorption.

In another embodiment, the first traffic barrier has an internal network of reinforcing steel. In another embodiment, the first traffic barrier is precast concrete having a minimum compressive strength of 28 MPa (4000 psi).

In another embodiment, the front sides of the traffic barriers have a sloped portion for controlled redirection of impacting vehicles.

In another embodiment, the vertical post may be an I-Beam or an H-Beam or W-flange Beam, all deemed to have an H-Shape for the purposes of this disclosure. In another embodiment, a subterranean footer surrounds the post below ground level. In another embodiment, the vertical post comprises a metric W250x49 steel post [US Customary W10x33]. In another embodiment, where exposed to higher wind loads or elevations, the vertical post comprises a metric W250x58 or W250x67 steel post.

DETAILED DESCRIPTION

The following description is presented to enable any person skilled in the art to make and use the invention and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown but is to be accorded the widest scope consistent with the principles and features disclosed herein.

Figure 1:
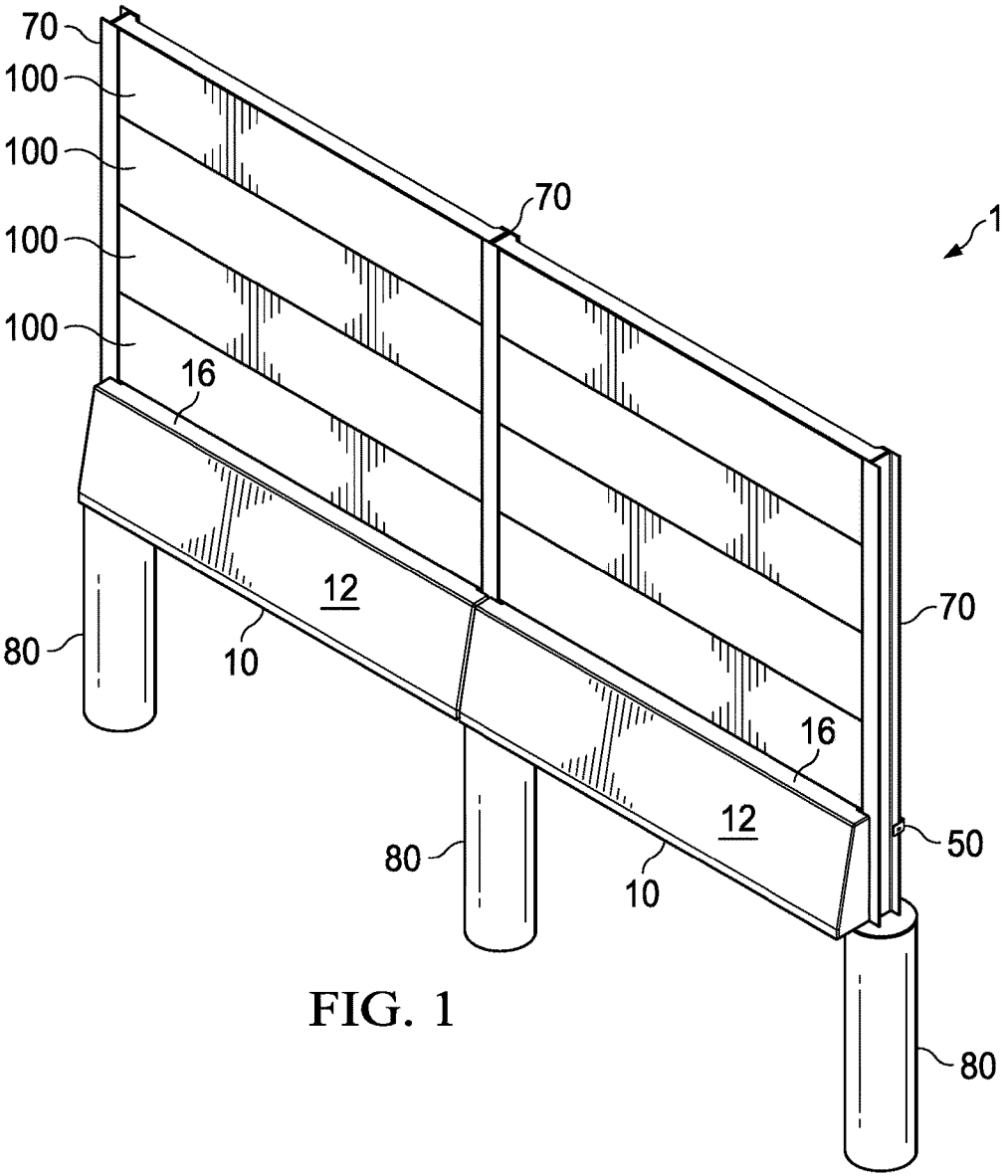
FIG. 1 is a perspective view of the front of a traffic barrier and soundwall system in accordance with one embodiment of the invention.

FIG. 1 is a perspective view of the front of a traffic barrier and soundwall system 1 in accordance with one embodiment of the invention. As shown in FIG. 1, subterranean footers 80 may be made of concrete and include reinforcing steel members 90 (not shown). A post 70 extends vertically upwards from footers 80. Traffic barriers 10 may be made of numerous materials, including most commonly of precast concrete. Traffic barriers 10 have a front 12 and a top 16.

In accordance with this embodiment, traffic barriers 10 can be beneficially positioned without the time, cost, or risk of raising them above posts 70. As a further benefit of this embodiment, traffic barriers 10 need not be welded or bolted directly to posts 70.

Sound barrier panels 100 are set between posts 70, and on top 16 of concrete traffic barriers 10. Additional sound barrier panels 100 may also be set between posts 70, on the top of the lower positioned sound barrier panels 100.

Figure 2:
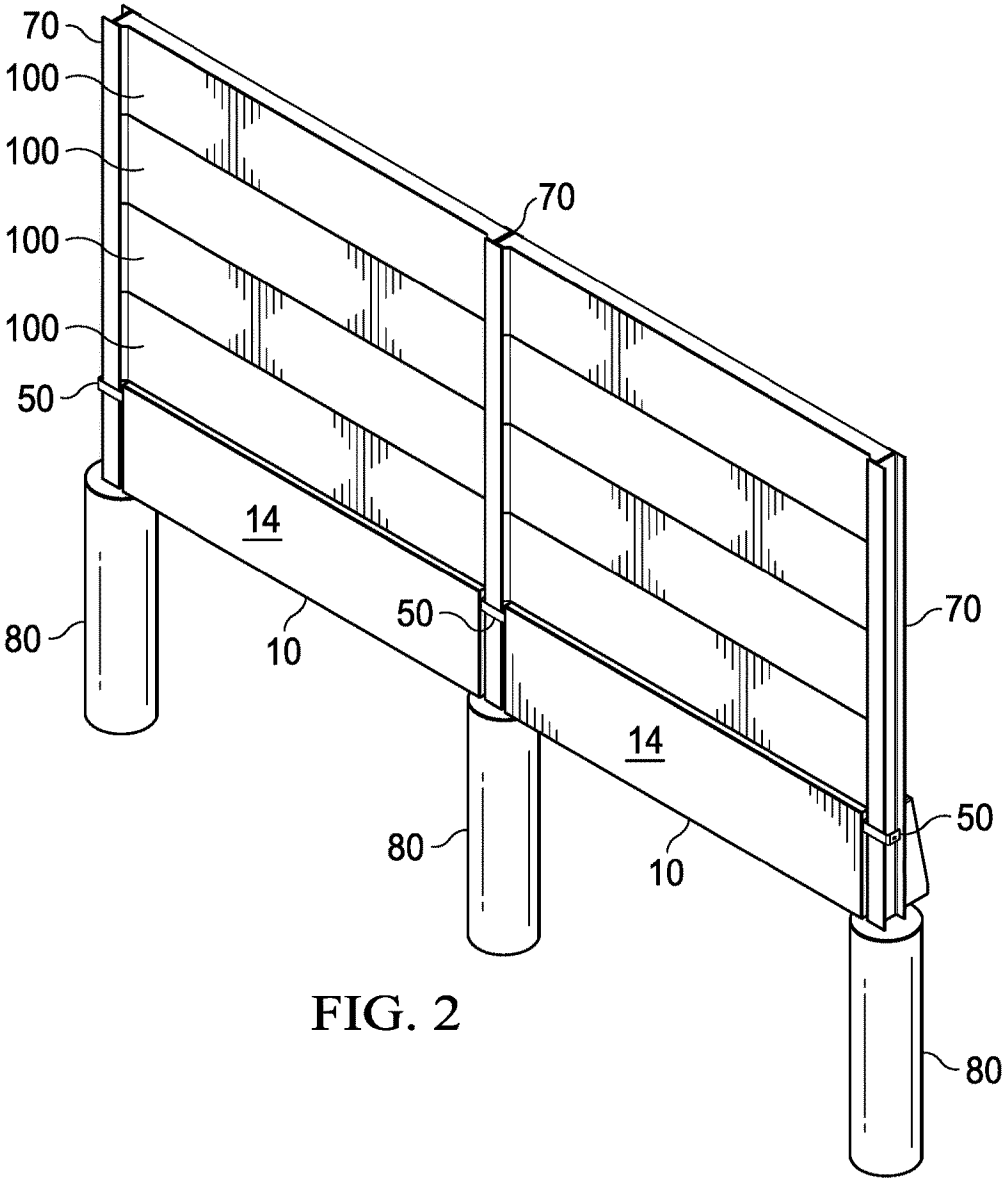
FIG. 2 is a perspective view of the back side of the traffic barrier and soundwall system illustrated in FIG. 1.

FIG. 2 is a rear perspective view of this embodiment. As shown in FIG. 2, traffic barriers 10 are positioned between posts 70 in approximate alignment with back 14 of traffic barriers 10. Traffic barriers 10 are connected to each other around posts 70 by means of a strap connector 50. The connection of adjacent sections of traffic barriers 10 to each other around posts 70 and to footers 80 provides a significantly improved resistance to dislocation of traffic barriers 10, significantly improves resistance to damage to sound barrier panels 100 and reduces risk to vehicle occupants upon impact of vehicles with traffic barrier and soundwall system 1.

Figure 3:
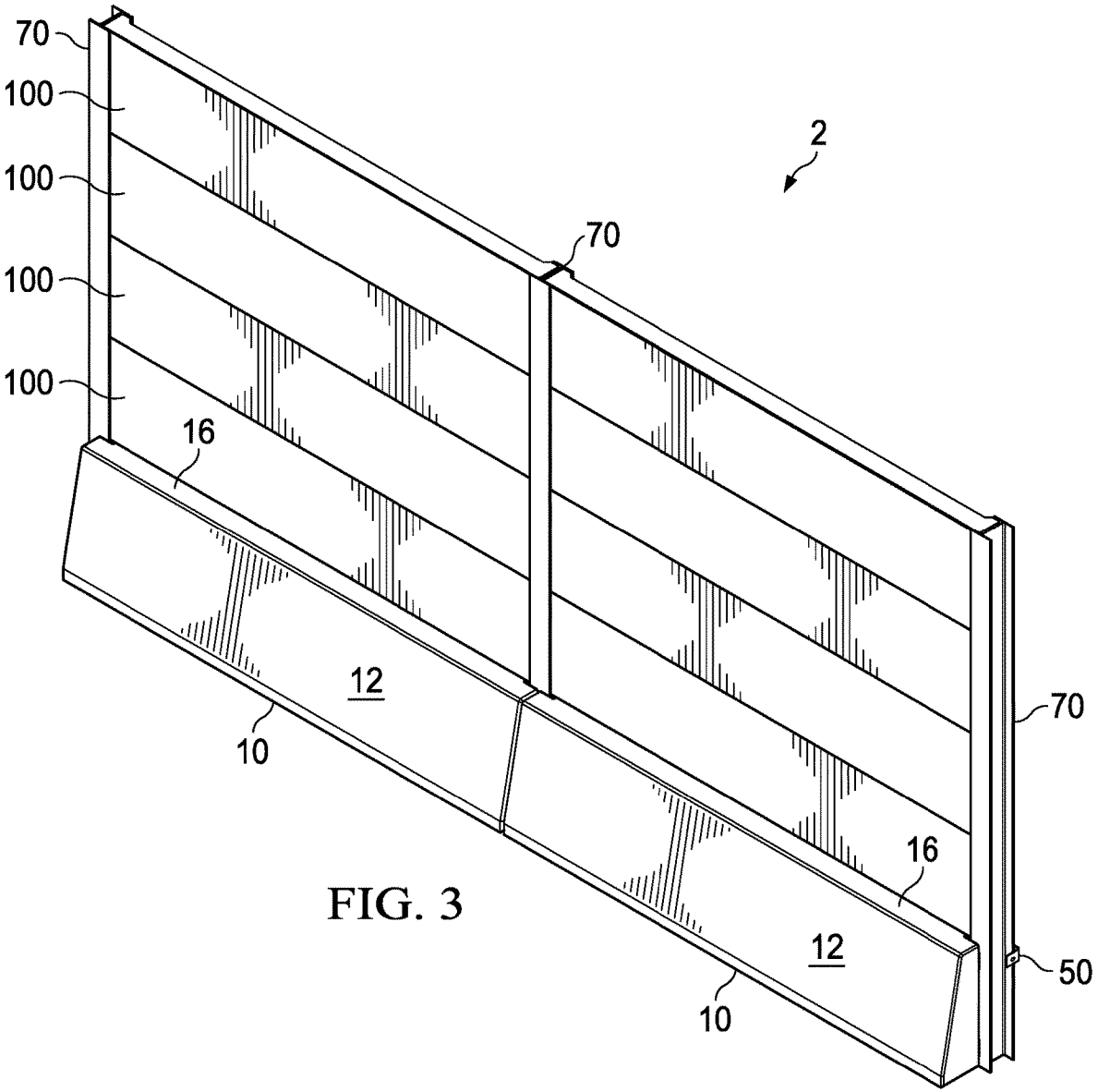
FIG. 3 is a perspective view of the front of a traffic barrier and soundwall system in accordance with another embodiment of the invention, in which no subterranean footers are used.

FIG. 3 is a perspective view of the front of a traffic barrier and soundwall system 1 in accordance with another embodiment of the invention in which no subterranean footers 80 are used.

Figure 4:
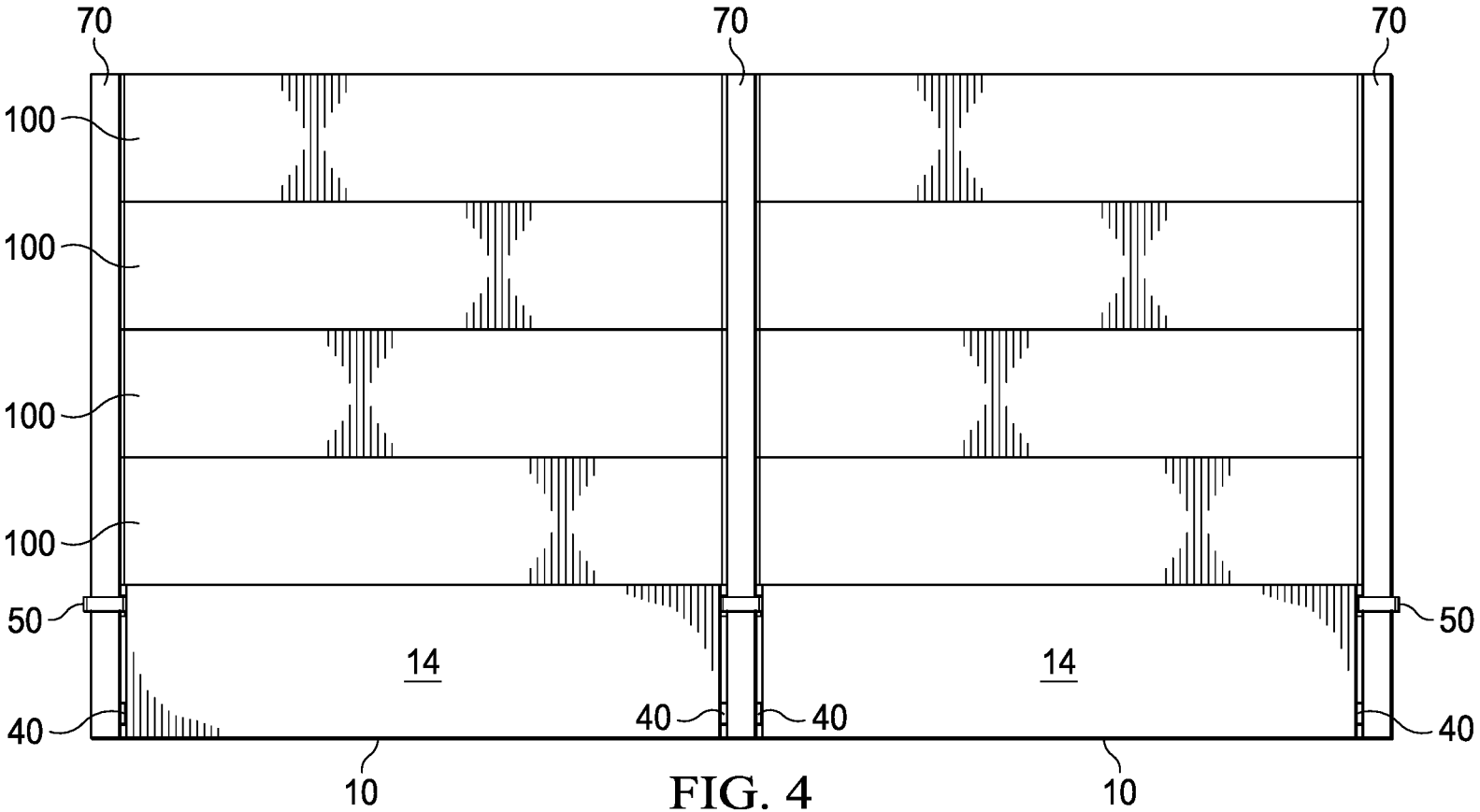
FIG. 4 is a perspective view of the back side of the traffic barrier and soundwall system illustrated in FIG. 3.

FIG. 4 is a perspective view from the back side of traffic barrier and soundwall system 1. As seen in this view, contact between traffic barriers 10 and posts 70 is buffered by the presence of angle brackets 40.

Figure 5:
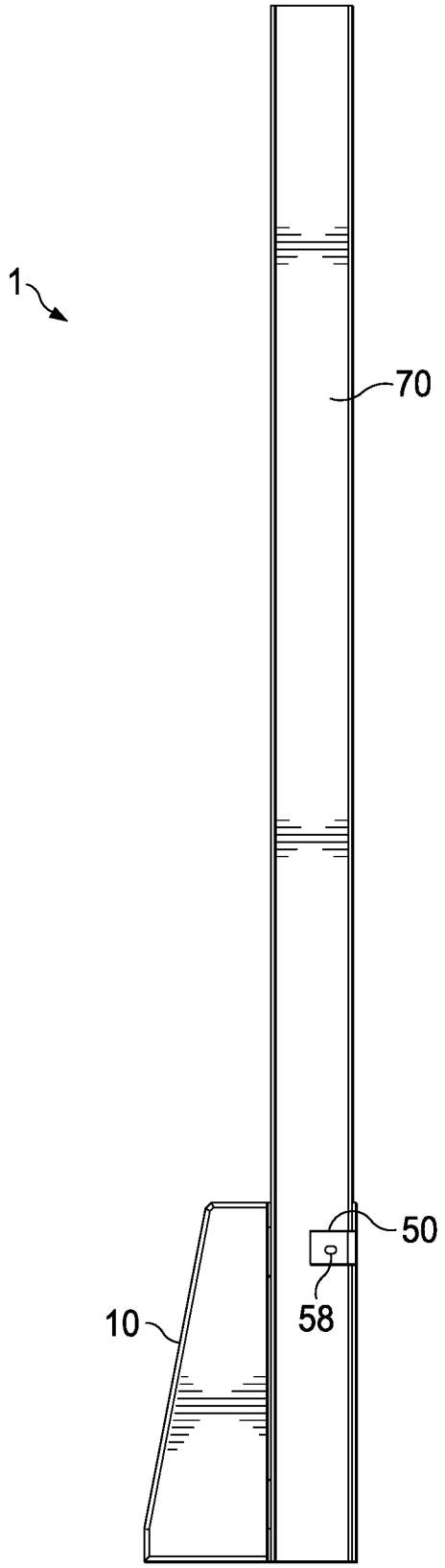
FIG. 5 is a side view of the traffic barrier and soundwall system illustrated in FIG. 1.

FIG. 5 is a side view of traffic barrier and soundwall system 1. As seen in this view, strap connectors 50 extend beyond post 70 for connection to the next traffic barrier 10.

Figure 6:
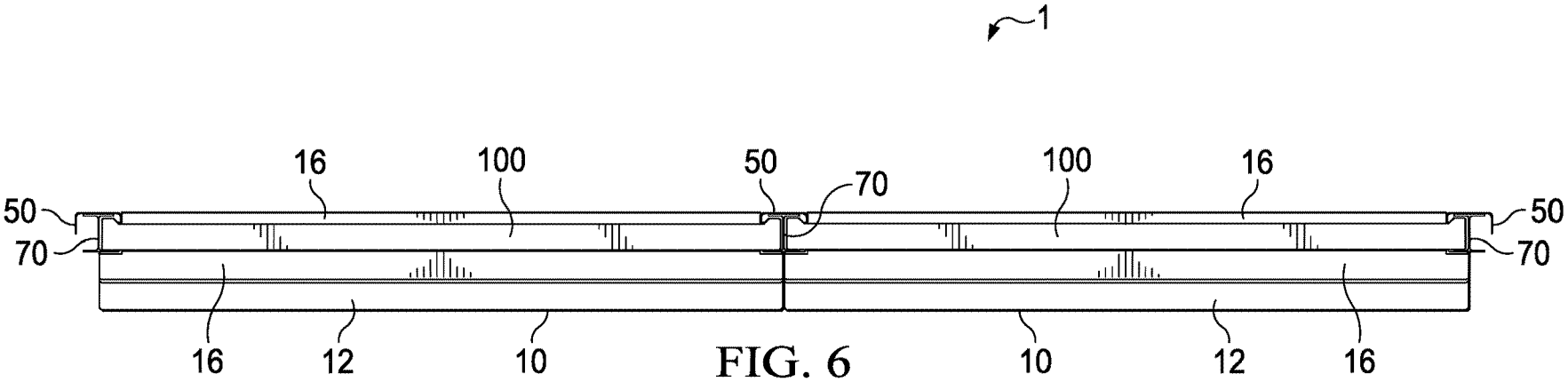
FIG. 6 is a top view of the traffic barrier and soundwall system illustrated in FIG. 1.

FIG. 6 is a top view of traffic barrier and soundwall system 1. As seen in FIG. 1, sound barrier panels 100 rest on top of a top surface 16 of traffic barrier 10.

Figure 7:
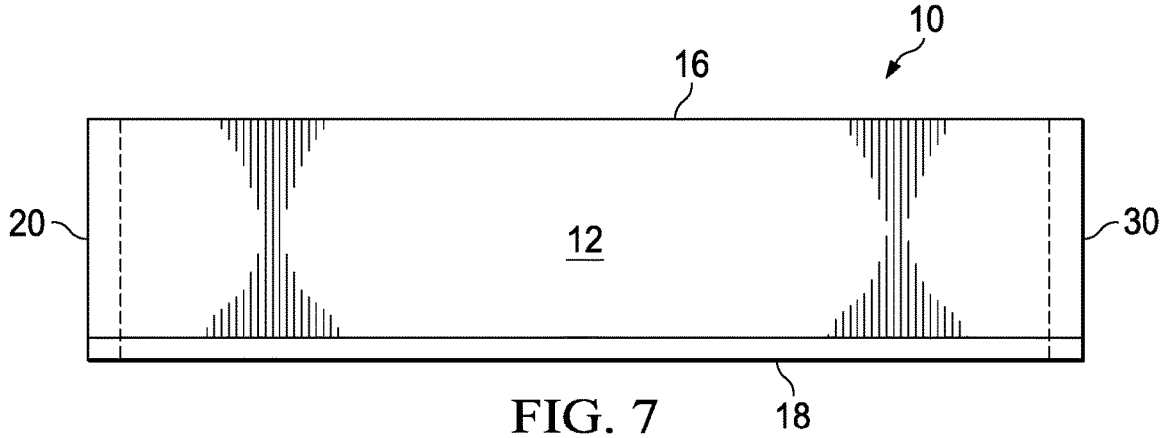
FIG. 7 is a front view of an embodiment of a traffic barrier 10 as may be incorporated into the traffic barrier and soundwall system 1 illustrated in FIG. 1.
Figure 8:
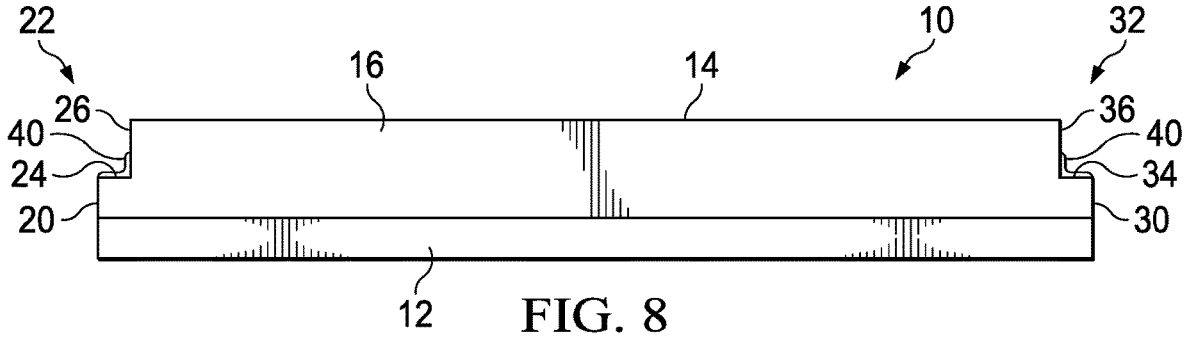
FIG. 8 is a top view of the embodiment of the traffic barrier illustrated in FIG. 7.
Figure 9:
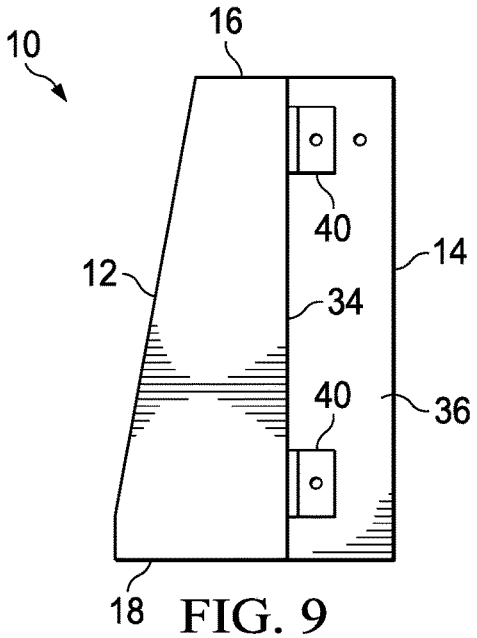
FIG. 9 is an end view of the embodiment of the traffic barrier illustrated in FIG. 7.

FIG. 7 is a front view of an embodiment of traffic barrier 10 as may be incorporated into traffic barrier and soundwall system 1. FIG. 8 is a top view of the same embodiment of traffic barrier 10. FIG. 9 is an end view of the embodiment of the traffic barrier illustrated in FIGS. 7 and 8. As seen in FIG. 9, more than one angle bracket 40 may be located in first recess 22 and second recess 32.

Referring to FIGS. 7-9, traffic barrier 10 comprises a front 12 and an opposite back 14, and a top 16 and a bottom 18. In one embodiment, front surface 12 is angled towards back 14 at an angle of approximately 10 degrees, making top 16 narrower than bottom 18.

Referring to FIG. 8, traffic barrier 10 also has a first end 20 and an opposite second end 30. A first recess 22 is located at the intersection of back 14 and first end 20. A second recess 32 is located at the intersection of back 14 and second end 30. First recess 22 has a recess front 24 and a recess end 26. Similarly, second recess 32 has a recess front 34 and a recess end 36. Recess 22 and recess 32 are sized to accommodate one-half of the width of post 70.

An angle bracket 40 is located at the intersection of recess front 24 and recess end 26 of the first recess 22. An angle bracket 40 is also located at the intersection of recess front 34 and recess end 36 of second recess 32.

Figure 10:
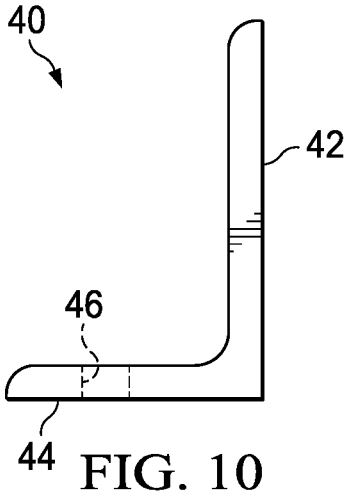
FIG. 10 is a top view of an embodiment of an angle bracket as may be incorporated into the traffic barrier and soundwall system illustrated in FIG. 1.
Figure 11:
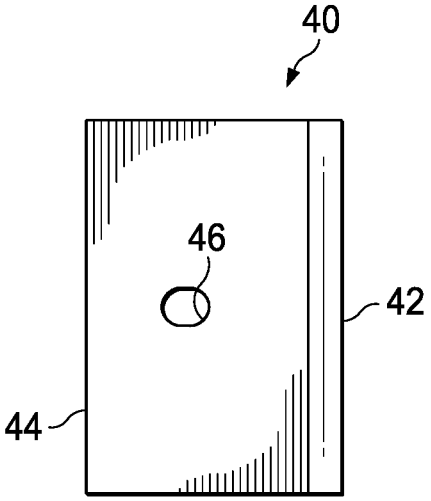
FIG. 11 is a side view of the embodiment of the angle bracket illustrated in FIG. 10.
Figure 14:
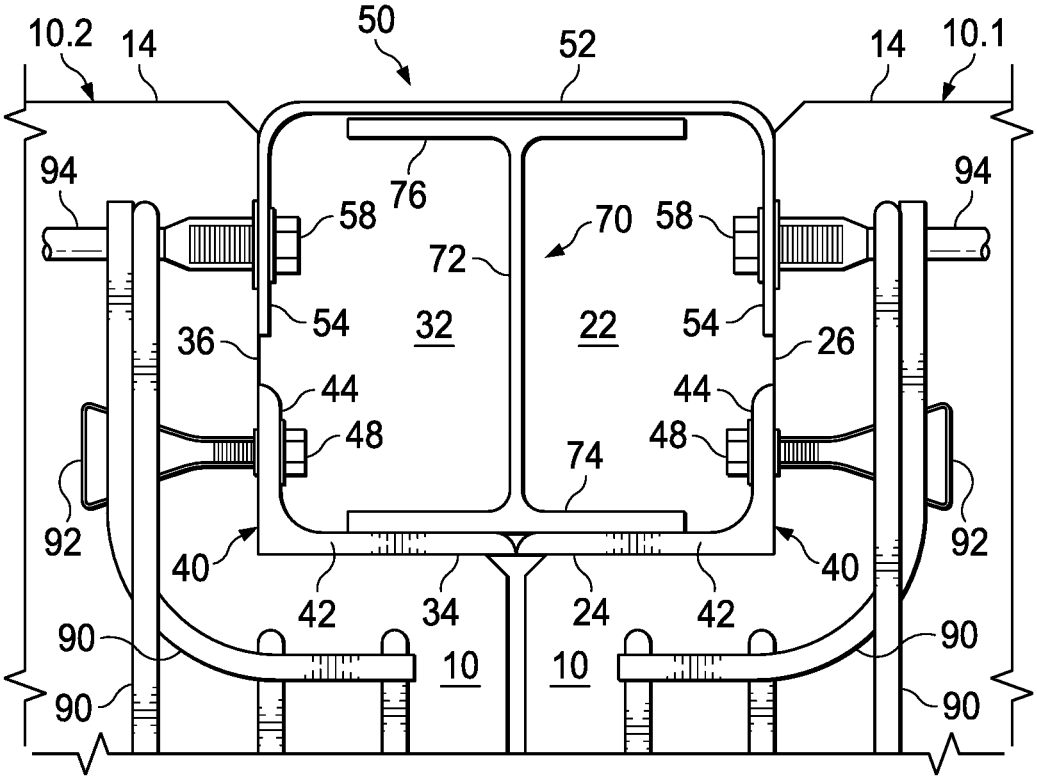
FIG. 14 is a top view of the brackets and strap connector embodiments of FIGS. 10-13 illustrated connecting adjacent traffic barriers to each other in accordance with an embodiment of the invention.

FIG. 10 is a top view of an embodiment of angle bracket 40 as may be incorporated into traffic barrier and soundwall system 1 illustrated in FIG. 1. FIG. 11 is a side view of the same embodiment of angle bracket 40. Referring to FIGS. 10 and 11, angle bracket 40 has a bracket front 42 and a bracket end 44. An orifice 46 may be advantageously located on angle bracket 40 bracket end 44 for receiving a bracket fastener 48. As best seen in FIGS. 8 and 14, angle bracket 40 is located in each of first recess 22 and second recess 32 of traffic barrier 10.

As best seen in FIG. 14, recess end 26 and recess end 36 may have inserts 92 precast or inserted therein for receiving bracket fasteners 48 in threaded connection. Angle brackets 40 function to provide an intermediate engagement with steel post 70 when vehicular impact with traffic and sound barrier system 1 produces lateral loads from movement of traffic barrier 10. This engagement minimizes damage to the concrete surfaces of traffic barrier 10.

Figure 12:
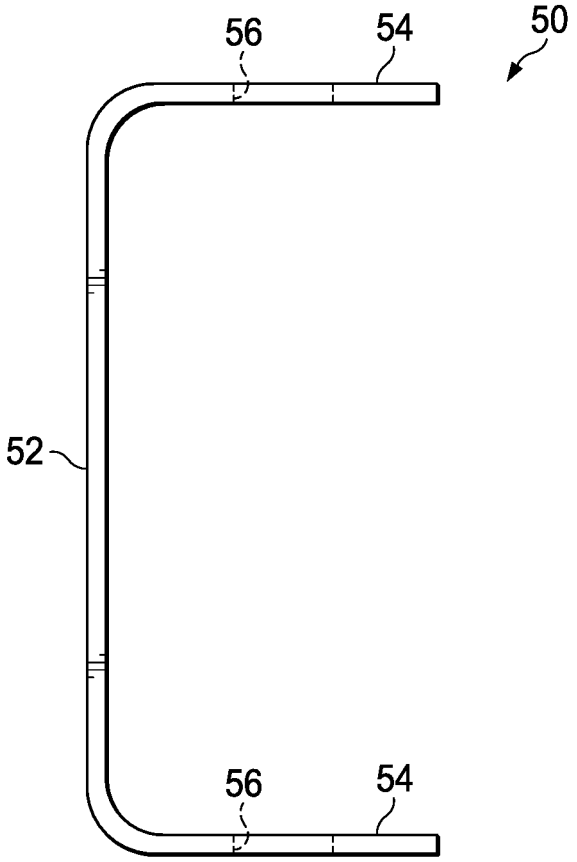
FIG. 12 is a top view of an embodiment of a connector strap as may be incorporated into the traffic barrier and soundwall system illustrated in FIG. 1.
Figure 13:
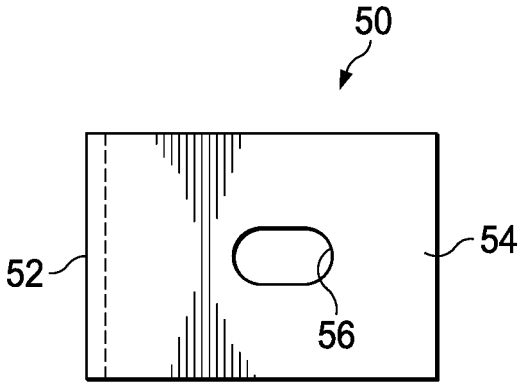
FIG. 13 is a side view of the embodiment of the strap connector illustrated in FIG. 12.

To minimize damage resulting from engagement of concrete traffic barrier 10 with steel post 70, angle bracket 40 may be made of metal, such as steel. In another embodiment, angle bracket 40 is made of a compressible material such as a thermoplastic polymer. In another embodiment, angle bracket 40 is made of a high-density polyethylene (HDPE). FIG. 12 is a top view of an embodiment of strap 50 as may be incorporated into traffic and sound barrier system 1. FIG. 13 is a side view of the same embodiment of strap 50. Referring to FIGS. 12 and 13, U-shaped metal strap 50 has a base 52 and a pair of arms 54 extending perpendicularly away from base 52. An orifice 56 is located on each arm 54 for receiving a strap fastener 58 (see FIG. 14).

FIG. 14 is a top view of angle brackets 40 and strap connector 50 illustrating the connection of adjacent traffic barriers 10.1 and 10.2 around post 70 in the manner that is unique to the present invention. As seen in FIG. 14, recess end 26 and recess end 36 may have inserts 94 precast or inserted therein for receiving strap fasteners 58 in threaded connection. As seen in FIG. 14, strap fastener 58 secures arms 54 of strap connector 50 to traffic barriers 10.1 and 10.2.

As best seen in this view (see also FIGS. 1-4), post 70 is located along a roadway to be barricaded. Post 70 is a wide-flanged vertical post. As used herein, the term "wide-flanged post" is understood to include I-Beams, H-Beams or W-flange Beams, all of which are beams understood to generally have an H-Shape. As used herein, the term "post" is understood to include vertically positioned beams.

In the embodiment illustrated, post 70 is "H-shaped". In one embodiment, post 70 is a metric W250x49 [US Customary W10x33] steel post. Post 70 has a central web 72 and a first flange 74 centered on an end of web 72. A second flange 76 is centered on an opposite end of web 72. First flange 74 and second flange 76 are identified separately only for the purpose of describing the orientation of post 70, as first flange 74 and second flange 76 are structurally identical.

Post 70 is oriented with first flange 74 facing a roadway to be barricaded. First traffic barrier 10.1 is positioned with first recess 22 on the right side of post 70. Second traffic barrier 10.2 is positioned adjacent to first traffic barrier 10.1 with second recess 32 of second traffic barrier 10.2 on the left side of post 70. In this position, angle brackets 40 of first and second traffic barriers 10.1 and 10.2 engaged first flange 74 of post 70.

Strap connector 50 is then positioned against second flange 76 of post 70. Strap fastener 58 secures one arm 54 of strap connector 50 to recess end 26 of first traffic barrier 10.1. Another strap fastener 58 secures the other arm 54 of strap connector 50 to recess end 36 of second traffic barrier 10.2. Base 52 of strap connector 50 surrounds second flange 76 of post 70 and thus secures first traffic barrier 10.1 and second traffic barrier 10.2 together around post 70.

In the embodiment illustrated, strap fastener 58 is threadedly connected to a strap insert 94. Strap insert 94 may be precast into the concrete body of traffic barrier 10 and may be connected to the network of reinforcing steel members 90 within traffic barrier 10. The connections thus realized provide a superior resistance to dislocation of traffic barriers 10 and significantly enhanced protection of sound barrier elements 100. More specifically, dislocation of any traffic barrier 10 results in a tensile distribution of the stress of the impact throughout the length of series connected traffic barriers 10.

As shown in FIG. 14, angle bracket 40 is located in each of first recess 22 of traffic barrier 10.1 and second recess 32 of adjacent traffic barrier 10.2. Angle bracket 40 is located at the intersection of recess front 24 and recess end 26 of first recess 22. Angle bracket 40 is located such that bracket front 42 is positioned against recess front 24 and bracket end 44 is positioned against recess end 26. Bracket fastener 48 secures angle bracket 40 to traffic barrier 10.1. In the embodiment illustrated, bracket fastener 48 is threadedly connected to a bracket insert 92. Bracket insert 92 may be precast into the concrete body of traffic barrier 10 and may be connected to the network of reinforcing steel members 90 within traffic barrier 10.

An angle bracket 40 is similarly located at the intersection of recess front 34 and recess end 36 of second recess 32 of adjacent traffic barrier 10.2 and connected in the same manner as angle bracket 40 is in first recess 22 of traffic barrier 10.1.

Angle brackets 40 function to provide a steel engagement with steel post 70. When trucks or other vehicles impact traffic barrier and soundwall system 1 and produce lateral loads into traffic barrier 10, the steel-to-steel engagement between angle brackets 40 and post 70 minimizes damage to the concrete surfaces of traffic barrier 10.

Figure 16:
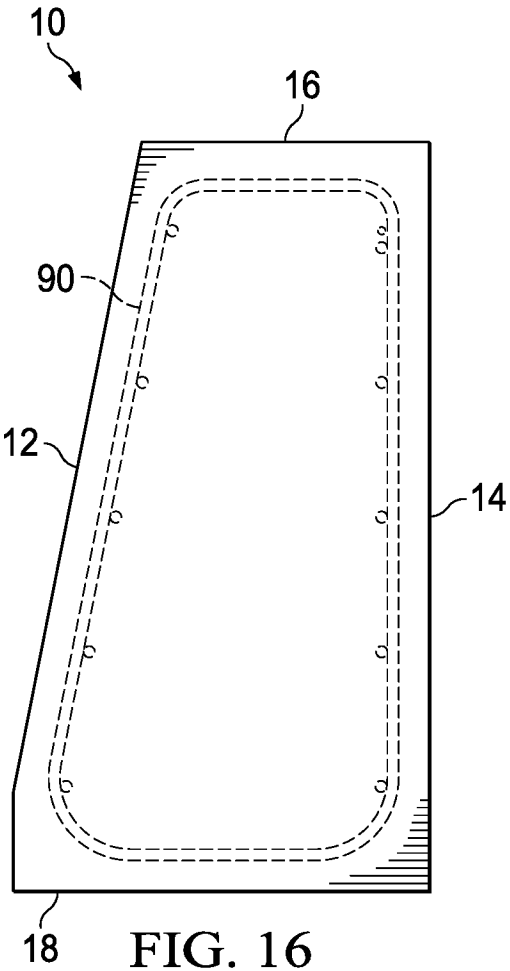
FIG. 16 is a center portion side-sectional view illustrating an exemplary reinforcing steel structure.
Figure 15:
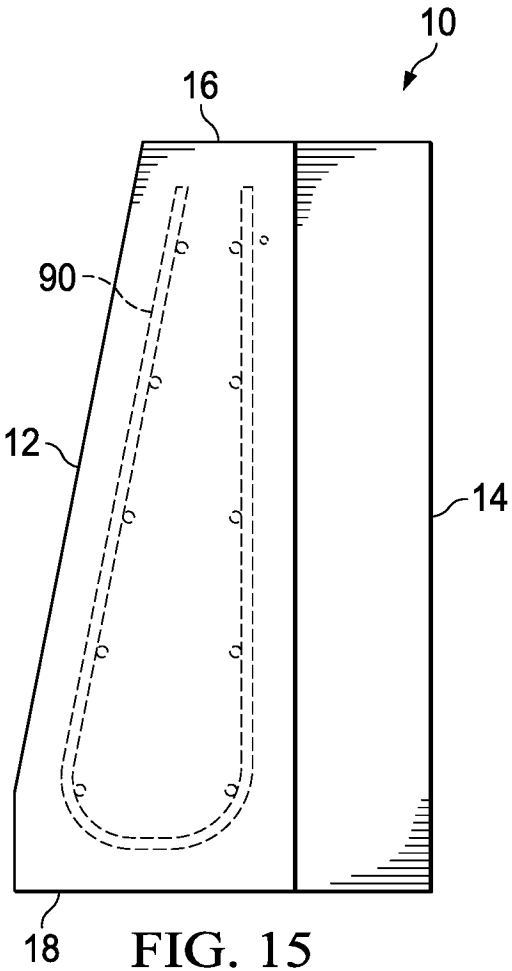
FIG. 15 is an end portion side-sectional view illustrating an exemplary reinforcing steel structure.

FIG. 15 is an end portion side-sectional view of traffic barrier 10 illustrating an exemplary reinforcing steel structure member 90 interior to traffic barrier 10. FIG. 16 is a center portion side-sectional view of traffic barrier 10 illustrating an exemplary reinforcing steel structure member 90 interior to traffic barrier 10.

Figure 17:
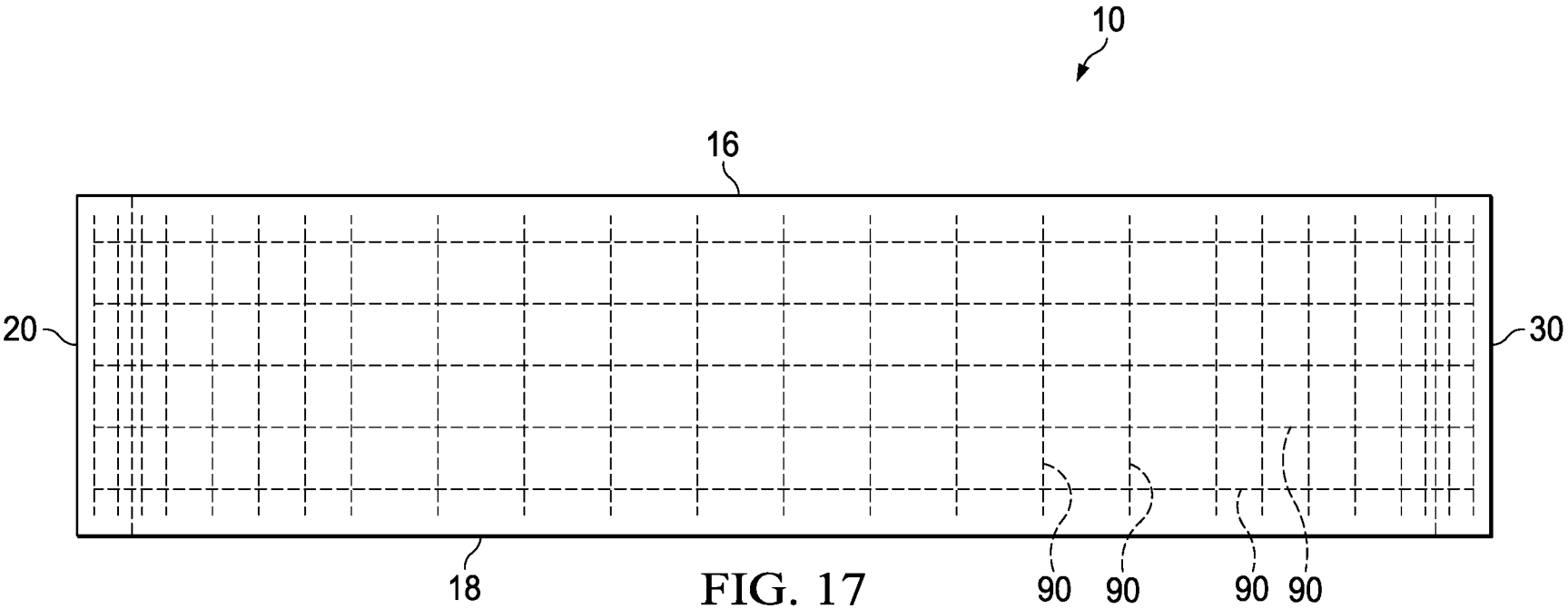
FIG. 17 is a front-sectional view illustrating an exemplary reinforcing steel structure.

FIG. 17 is a front-sectional view illustrating an exemplary network of reinforcing steel structure members 90.

As used herein, the term "substantially" is intended for construction as meaning "more so than not." It will be understood by one of ordinary skill in the art that although described in primary geometric terms, conventional manufacturing and casting practices may employ chamfered, beveled or radius edges. As an example, only, and not as a limitation, precast concrete traffic barriers may have 15 mm×45° chamfers.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and, in a manner, consistent with the scope of the invention.

The invention claimed is:

1. A traffic and sound barrier system, comprising:

a plurality of wide-flanged vertical posts having a central web and a first flange centered on an end of the web and a second flange centered on an opposite end of the web;

the posts oriented with the first flange facing a roadway;

a first traffic barrier located between a first and second post;

a second traffic barrier located between the second and a third post;

each traffic barrier comprising:

a front and an opposite back;

a first end and an opposite second end;

a top and a bottom;

a first recess located at the intersection of the back and the first end;

a second recess located at the intersection of the back and the second end;

the first recess and second recess having a recess front and a recess end;

a U-shaped strap having a base and a pair of arms extending perpendicularly away from the base;

an orifice located on each arm of the strap;

the first and second traffic barriers positioned such that the first recess of the first traffic barrier and the second recess of the second traffic barrier are adjacent to the first flange of the second post;

a strap fastener connecting one arm of the strap to the first recess of the first traffic barrier;

a strap fastener connecting the other arm of the strap to the second recess of the second traffic barrier;

the base of the strap surrounding the second flange of the second post to secure the first and second traffic barriers together;

a sound barrier panel located on the top of the first traffic barrier; and, the sound barrier extending between the web of the first post and the web of the second post.

2. The traffic and sound barrier system of claim 1, further comprising:

an L-shaped angle bracket having a bracket front and a bracket end;

the angle bracket located adjacent the recess front and recess end of each of the first and second recesses of the first and second traffic barriers;

a bracket fastener securing each angle bracket to the traffic barriers; and, the first and second traffic barriers positioned such that the bracket front in the first recess of the first traffic barrier and the bracket front in the second recess of the second traffic barrier are adjacent to the first flange of the second post.

3. The traffic and sound barrier section of claim 2, further comprising:

the angle bracket being made of steel.

4. The traffic and sound barrier section of claim 2, further comprising:

the angle bracket being made of a non-metallic compressible material.

5. The traffic and sound barrier section of claim 2, further comprising:

the angle bracket being made of a high-density polyethylene (HDPE).

6. The traffic and sound barrier system of claim 1, further comprising:

the front side of the first traffic barrier having a sloped portion.

7. The traffic and sound barrier system of claim 2, further comprising:

the bracket fastener passing through the recess end of the first traffic barrier to secure the angle bracket to the first traffic barrier.

8. The traffic and sound barrier section of claim 1, further comprising:

the strap fastener passing through the recess end of the first traffic barrier to secure the strap to the first traffic barrier.

9. The traffic and sound barrier section of claim 1, further comprising:

the first traffic barrier having an internal reinforcing steel component.

10. The traffic and sound barrier system of claim 2, further comprising:

a bracket insert precast into the first traffic barrier for receiving the bracket fastener; and, the bracket insert connected to a reinforcing steel network inside the first traffic barrier.

11. The traffic and sound barrier system of claim 1, further comprising:

a strap insert precast into the first traffic barrier for receiving the strap fastener; and, the strap insert connected to a reinforcing steel network inside the first traffic barrier.

12. The traffic and sound barrier system of claim 1, further comprising:

the strap fastener located proximate the top of the first traffic barrier to permit access for rotating the strap fastener to make its connection to the first traffic barrier.

13. The traffic and sound barrier system of claim 2, further comprising:

the first traffic barrier being precast concrete having a minimum compressive strength of 28 Mpa (4000 psi).

14. The traffic and sound barrier system of claim 1, further comprising:

a subterranean footer surrounds the post below ground level.

15. The traffic and sound barrier system of claim 1, further comprising:

the wide-flanged vertical post being a W250x49 steel post.

* * * * *